US010300522B2

(12) United States Patent
Watanabe et al.

(10) Patent No.: US 10,300,522 B2
(45) Date of Patent: May 28, 2019

(54) FORMING METHOD FOR DISK-SHAPED COMPONENT AND FORMING DEVICE FOR DISK-SHAPED COMPONENT

(71) Applicant: MITSUBISHI HEAVY INDUSTRIES COMPRESSOR CORPORATION, Tokyo (JP)

(72) Inventors: Yujiro Watanabe, Tokyo (JP); Nobuyori Yagi, Tokyo (JP); Atsushi Kawasaki, Tokyo (JP); Ken Ishii, Tokyo (JP); Kazutoshi Yokoo, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 15/553,496

(22) PCT Filed: Oct. 23, 2015

(86) PCT No.: PCT/JP2015/079956
§ 371 (c)(1),
(2) Date: Aug. 24, 2017

(87) PCT Pub. No.: WO2016/136022
PCT Pub. Date: Sep. 1, 2016

(65) Prior Publication Data

US 2018/0056366 A1 Mar. 1, 2018

(30) Foreign Application Priority Data

Feb. 26, 2015 (JP) ..... 2015-037212

(51) Int. Cl.
*B21D 22/16* (2006.01)
*B21H 1/02* (2006.01)
*B21J 1/06* (2006.01)

(52) U.S. Cl.
CPC ..... *B21H 1/02* (2013.01); *B21D 22/16* (2013.01); *B21J 1/06* (2013.01)

(58) Field of Classification Search
CPC ..... B21H 1/02; B21J 1/06; B21D 22/16
See application file for complete search history.

(56) References Cited

U.S. PATENT DOCUMENTS

2004/0134249 A1 7/2004 Utiashev et al.
2012/0279268 A1 11/2012 Loveless et al.

FOREIGN PATENT DOCUMENTS

DE 19545177 A1 8/1996
GB 300.230 A 11/1928
JP S62-207525 A 9/1987
(Continued)

OTHER PUBLICATIONS

International Search Report for corresponding International Application No. PCT/JP2015/079956, dated Dec. 22, 2015 (4 pages).
(Continued)

*Primary Examiner* — David B Jones
(74) *Attorney, Agent, or Firm* — Osha Liang LLP

(57) ABSTRACT

A forming method for a disk-shaped component includes: mounting a heated material on a table; applying a load to the material with a forming roll while rotating the table; forming the material into a disk shape using roll forging; and suppressing decrease in temperature of the material during forming using a heat retaining device.

4 Claims, 9 Drawing Sheets

(56) References Cited

FOREIGN PATENT DOCUMENTS

| | | | |
|---|---|---|---|
| JP | H05-285581 | A | 11/1993 |
| JP | H06-23637 | U | 3/1994 |
| JP | 2002-263767 | A | 9/2002 |
| JP | 3680001 | B2 | 8/2005 |
| JP | 2008018446 | A | 1/2008 |
| JP | 2012-030234 | A | 2/2012 |
| JP | 2013-220464 | A | 10/2013 |
| RU | 2031753 | C1 | 3/1995 |

OTHER PUBLICATIONS

Written Opinion for corresponding International Application No. PCT/JP2015/079956, dated Dec. 2, 2015 (10 pages).

FORMING METHOD FOR DISK-SHAPED COMPONENT AND FORMING DEVICE FOR DISK-SHAPED COMPONENT

TECHNICAL FIELD

The present invention relates to a method and a forming device for a disk-shaped component such as an impeller disk.

Priority is claimed on Japanese Patent Application No. 2015-037212, filed Feb. 26, 2015, the content of which is incorporated herein by reference.

BACKGROUND

As illustrated in FIG. 11, an impeller (a compressor impeller) 1 included in various hydraulic machines or pneumatic machines such as liquid pumps or electric generators includes blades 2, and an impeller disk 3 and an impeller cover 4 disposed such that the blades 2 are interposed therebetween.

The impeller disk or the impeller cover is formed into a truncated cone shape (a disk shape), using die forging, roll forging, or the like.

Specifically, when forming an impeller disk or the like using die forging, for example, a material (a rough forged material) extracted from a furnace is inserted into a central hole of a die having a predetermined shape and tapped, and the low-temperature material is placed in a furnace and reheated. By repeating insertion into the die and tapping, the material is gradually pushed out in a radial direction to finish the material into a desired shape.

When using roll forging, for example, a material extracted from the furnace is placed on a table of the forming device, the material is pressed by a forming roll, and by rotating the table, the material is gradually pushed out in the radial direction and is formed in a truncated cone shape. Further, by relatively moving the forming roll in the radial direction with respect to the table, and repeating reheating in which the low-temperature material is placed in the furnace, and roll forging, the material is finished into a desired shape (for, example, see Patent Literature 1).

PATENT LITERATURE

[Patent Literature 1]

Japanese Patent No. 3680001

Here, die forging has great advantages such as a high forming accuracy and a high material yield. Meanwhile, die forging requires many repetitions of operations of reheating and tapping (number of times of heating), requires time to form the material, and requires a die according to a shape for each shape of molded article.

In contrast, roll forging has a relatively high forming accuracy, a high material yield, a smaller number of times of heating than the die forging, and a short forming time.

On the other hand, in roll forging, in addition to direct heat radiation into the atmosphere, a decrease in temperature of the material easily occurs due to heat transfer to the table. For this reason, for example, when attempting to form a large-sized impeller disk or the like having an outer diameter exceeding 1,350 mm by roll forging, the rotational force (torque) of the table and the pressing force of the roll may exceed the equipment capacity due to the decrease in temperature of the material. Further, since a lower surface side of the material decreases in temperature earlier than an upper surface side due to the heat transfer to the table, a large difference occurs in an amount of deformation between the upper surface side and the lower surface side of the material, and shape failure in the molded article easily occurs.

That is, in the existing equipment for roll forging, there is a limit to the product size that can be forged due to the decrease in temperature of the material, particularly, the outer circumferential side and the lower surface side of the material due to the cooling during forming, and a forming load (reaction force) exceeding the equipment capacity may occur due to the decrease in temperature of the material during forming, or a shape failure (accuracy deterioration) may occur.

For this reason, large-sized impeller disks and the like having an outer diameter exceeding 1,350 mm are formed through manufacturing a die each time of die forging. There is a demand for a technique capable of manufacturing a molded article of large size by roll forging having the many advantages as described above.

Further, if the loaded weight (pressing force) on the material due to the forming roll is increased, it is possible to manufacture a molded article of a large size in existing equipment, but a large amount of capital investment is required to allow a larger loaded weight to be applied.

For this reason, it is strongly advantageous to be able to cope with products of large size, using existing equipment for roll forging.

SUMMARY

According one or more embodiments of the present invention, there is provided a forming method for a disk-shaped component, the method including: mounting a heated material on a table; applying a load to the material with a forming roll, while rotating the material by rotating the table; and forming the material into a disk shape by roll forging, wherein decrease in temperature of the material during forming is suppressed, using a heat retaining device.

According to one or more embodiments of the present invention, there is provided a forming device for a disk-shaped component which mounts a heated material on a table, applies a load to the material with a forming roll, while rotating the table by rotating the material, and forms the material into a disk shape by roll forging, the forming device including: a heat retaining device which suppresses decrease in temperature of the material during forming.

According one or more embodiments, when forming a disk-shaped component such as an impeller disk by roll forging, by heating or insulating the rotating material using a heat retaining device, it is possible to prevent a decrease in temperature of the material during molding. This makes it possible to inhibit or prevent an occurrence of a forming load exceeding the equipment capacity due to the decrease in temperature of the material or an occurrence of shape failure.

According to one or more embodiments of the present invention, in the forming method for a disk-shaped component according to the first aspect, a burner is used as the heat retaining device, and the material may be formed while heating the material by emitting a flame toward the rotating material using the burner.

According to one or more embodiments, it is possible to suppress decrease in temperature of the material during forming by emitting a flame toward the material using the burner as the heat retaining device. As a result, it is possible to adequately inhibit or prevent the occurrence of forming load exceeding the equipment capacity during forming or the occurrence of shape failure in the molded article.

Further, according to one or more embodiments of the present invention, in the forming method for a disk-shaped component according to the first or second aspect, an electric heater or an IH heater is used as the heat retaining device, and the material may be formed while heating the rotating material with a heater from the outer side using the electric heater or the IH heater.

According to one or more embodiments, by heating the material using an electric heater or an IH heater as the heat retaining device, it is possible to suppress decrease in temperature of the material during forming. Also, in this case, it is possible to inhibit or prevent the occurrence of forming load exceeding the equipment capacity during forming or the occurrence of shape failure in the molded article.

Further, according to one or more embodiments of the present invention, in the forming method for a disk-shaped component according to the first to third aspects, at least one of a heat insulating material and a radiation material is used as the heat retaining device, at least one of the heat insulating material and the radiation material is disposed on an outer side of the rotating material and the material may be formed.

According to one or more embodiments, by disposing at least one of the heat insulating material and the radiation material as the heat retaining device on the outer side of the material, it is possible to suppress decrease in temperature of the material during forming. Also in this case, it is possible to inhibit or prevent the occurrence of forming load exceeding the equipment capacity during forming or the occurrence of shape failure in the molded article.

According to one or more embodiments of the present invention, in the forming method for a disk-shaped component according to any one of the first to fourth aspects, the heat retaining device may be disposed in a range of 20° to 180° in the circumferential direction about a rotational axis of the material, and the range of 20° to 180° in the circumferential direction of the rotating material may be heated or insulated by the heat retaining device to suppress decrease in temperature of the material.

According to one or more embodiments, by heating or insulating the range of 20° to 180° in the circumferential direction of the rotating material, using the heat retaining device, it is possible to adequately suppress decrease in temperature of the material with the heat retaining device, while preventing occurrence of problems regarding the loaded weight applied to the material by the forming roll.

According to one or more embodiments of the present invention, in the forming method for a disk-shaped component according to any one of the first to fifth aspects, an inner circumferential side and an outer circumferential side of the upper surface of the rotating material, and a side surface forming the outer circumference may be heated or insulated by the heat retaining device to suppress decrease in temperature of the material.

According to one or more embodiments, by heating or insulating the inner circumferential side of the upper surface of the material, the outer circumferential side of the upper surface of the material, and the side surface forming the outer circumference of the material using the heat retaining device, it is possible to more adequately suppress decrease in temperature of the material.

In the above-described forming method for a disk-shaped component and the forming device for a disk-shaped component, when forming the disk-shaped component such as an impeller disk by roll forging, by heating or insulating the rotating material using a heat retaining device, it is possible to prevent the decrease in temperature of the material during forming. This makes it possible to inhibit or prevent occurrence of forming load exceeding the equipment capacity due to the decrease in temperature of the material or occurrence of shape failure.

Therefore, according to the forming method for a disk-shaped component and the forming device for a disk-shaped component of one or more embodiments the present invention, for example, even with existing equipment for roll forging which is difficult to apply to large-size forming when an outer diameter exceeds 1350 mm, it is possible to make this applicable to (cope with) manufacturing of a molded article of a large size merely by adding a heat retaining device.

DETAILED DESCRIPTION

Hereinafter, a forming method for a disk-shaped component and a forming device for a disk-shaped component according to one or more embodiments of the present invention will be described with reference to FIGS. 1 to 8 and 11.

In one or more embodiments, description will be given on the assumption that an impeller disk is formed. However, the forming method for the disk-shaped component and the forming device for the disk-shaped component of one or more embodiments of the present invention can be applied to manufacturing of all disk-shaped components that can be formed using roll forging, without being limited to an impeller disk.

Figure 1:
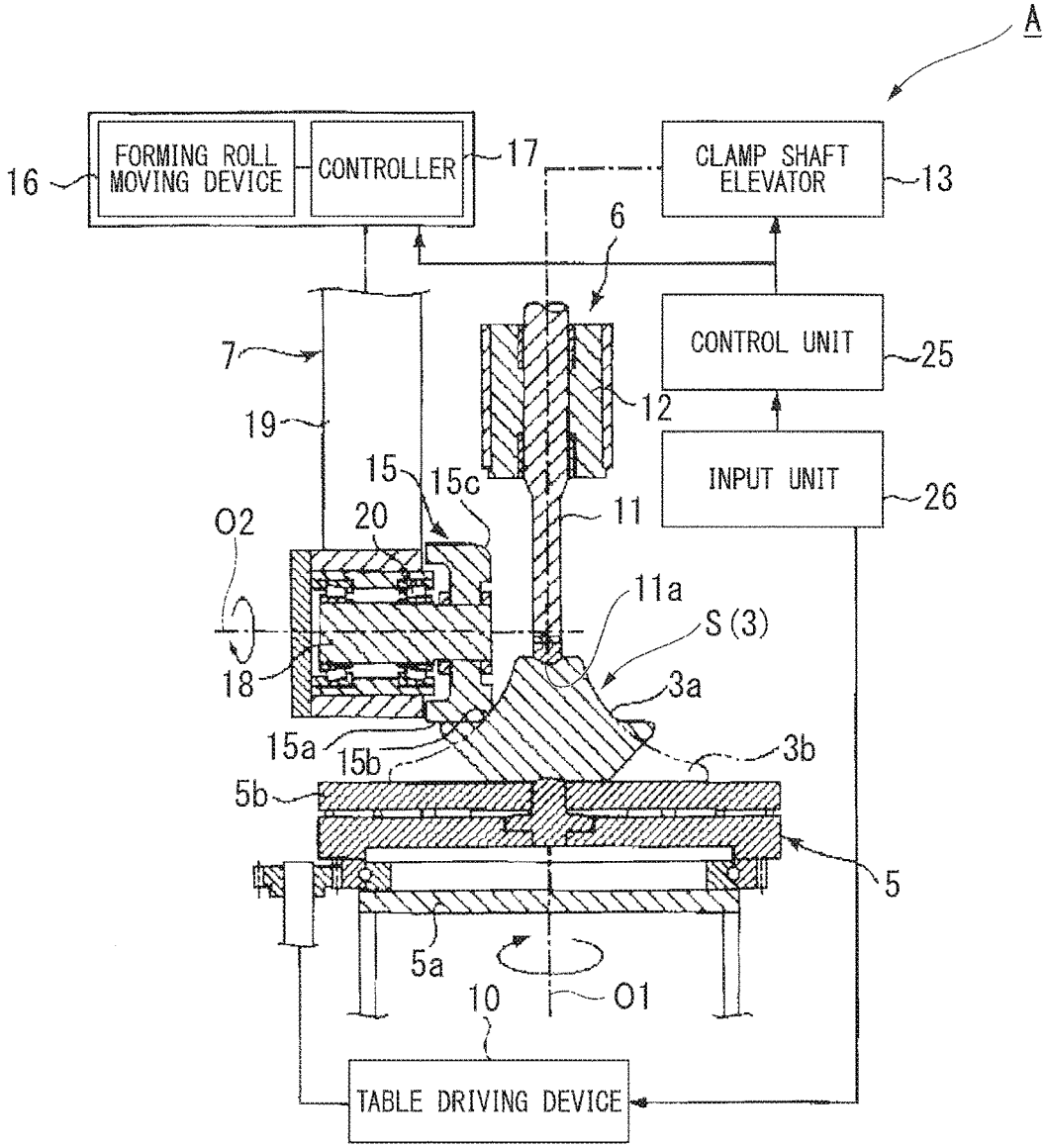
FIG. 1 is a view illustrating a forming device for a disk-shaped component according to one or more embodiments of the present invention.
Figure 2:
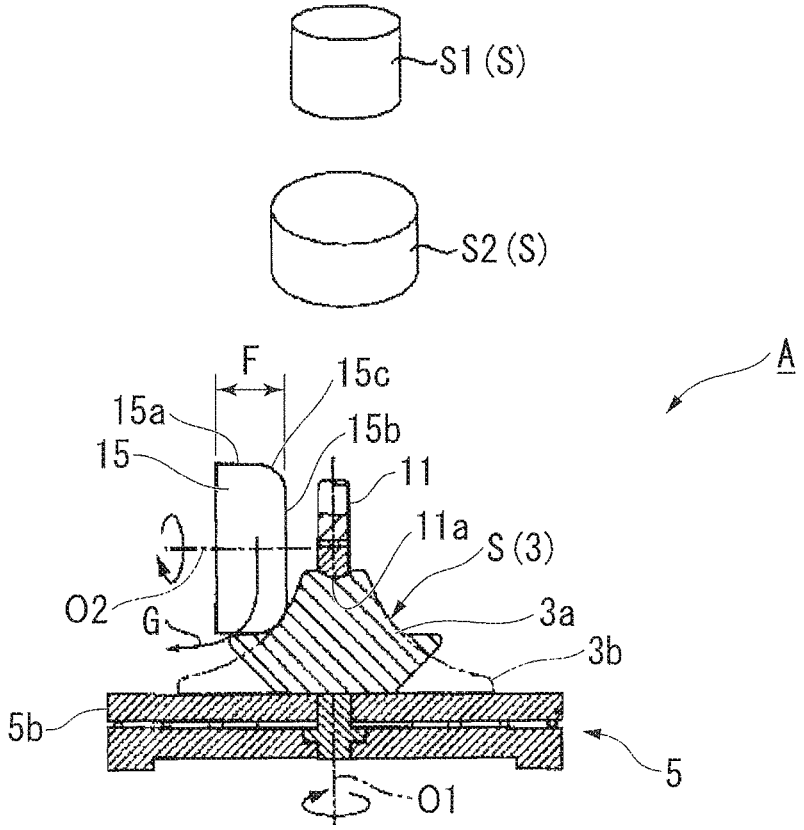
FIG. 2 is a view illustrating a forming device for a disk-shaped component and a forming method for a disk-shaped component according to one or more embodiments of the present invention.

As illustrated in FIGS. 1 and 2, a forming device (disk roll device) A for a disk-shaped component of one or more embodiments includes a forming table (table) 5, a clamp 6, and a forming processing unit 7.

The forming table 5 includes a table base 5*a*, and a table plate 5*b* having a circular shape in a plan view which is rotatably mounted on the table base 5*a* via bearings. The table plate 5*b* is formed of a metal or the like which is harder than a material S to be formed into an impeller disk (a disk-shaped component) 3 and has high heat resistance, and a ring-shaped gear is provided on the circumferential portion of the table plate 5*b*.

An output gear of a table driver 10, which has an electric motor or the like as a driving source, engages with the gear of the forming table 5. As a result, the table plate 5*b* is driven by the table driver 10 and is rotated in one direction around a central axis O1 extending in a vertical direction at a desired speed.

A clamp 6 is disposed above the forming table 5 to face the upper surface of the forming table 5. The clamp 6 includes a clamp shaft 11, a holder 12, and a clamp shaft elevator 13.

The clamp shaft 11 is provided coaxially with the central axis O1 of the forming table 5. The clamp shaft 11 passes through the holder 12 and is supported by the holder 12 to freely rotate about the axis O1 and to be freely slidable in the direction of the axis O1. The clamp shaft elevator 13 is driven by an electric motor, a hydraulic cylinder or the like. The clamp shaft elevator 13 is connected to the upper portion of the clamp shaft 11. The clamp shaft 11 is vertically moved up and down by driving the clamp shaft elevator 13.

The forming processing unit 7 is placed on the forming table 5 and presses and plastically deforms the material S held by the clamp 6 to form the material S into a predetermined disk shape. The forming processing unit 7 includes a forming roll 15, a forming roll moving device 16, and a controller 17.

The forming roll 15 is made of a metal harder than the material S, and is formed in a substantially ring shape. The forming roll 15 has a roll circumferential surface 15*a* as a material pressing surface, a roll end surface 15*b*, and a roll shoulder surface 15*c*, on the outer circumferential surface side coming into contact with the material S.

The roll circumferential surface 15*a* is a portion having a substantially constant outer diameter, and at the time of forming an inclined surface 3*a* of the impeller disk 3, a portion expanding to the edge of the material S and the outer circumferential portion 3*b* of the impeller disk 3 are pressurized and pressed against the forming table 5. The roll circumferential surface 15*a* prevents tensile stress from acting on the outer circumferential portion 3*b* in the circumferential direction when the outer circumferential portion is expanded at the time of forming the material S. Further, the roll circumferential surface 15*a* has an appropriate width dimension F with which a compressive stress can be applied by pressing the outer circumferential portion 3*b* pressed and expanded in the radial direction against the forming table 5.

The roll shoulder surface 15*c* is a curved surface which smoothly connects the roll end surface 15*b* located toward the center of the forming table 5 and the roll circumferential surface 15*a*. The radius of curvature of the roll shoulder surface 15*c* is set to be smaller than the radius of curvature of the inclined surface 3*a* of the impeller disk 3.

The forming roll 15 configured as described above is connected to one end portion of the rotating shaft 18 extending in the horizontal direction. The rotating shaft 18 is supported at a tip (lower end) portion of a movable roll support 19 extending in the vertical direction via a bearing 20 to be freely rotatable about the axis O2. The roll end surface 15*b* of the forming roll 15 faces the central of the forming table 5. The forming roll 15 is able to be freely rotated about the axis O2 extending horizontally by the rotating shaft 18.

The movable roll support 19 is movable in the vertical direction and in the horizontal direction by the forming roll moving device 16. The forming roll moving device 16 includes a vertical guide and a horizontal guide which independently guide the movement of the movable roll support 19 in the vertical direction and the horizontal direction, respectively, and a vertical movement unit and a horizontal movement unit which move the movable roll support 19 along the guide, using a servo motor or the like as a driving source.

The controller 17 controls the driving of the forming roll moving device 16. When the forming roll 15 is in contact with the material S, the controller 17 controls a driving source such as a servo motor such that it relatively moves the forming roll 15 with respect to the table 5 along the target shape of the impeller disk 3, while maintaining a state in which its tangential speed is constant.

The forming processing unit 7, the table driver 10, and the clamp shaft elevator 13 are controlled by the control unit 25, respectively. An input unit 26 such as a keyboard is connected to the control unit 25. Rotation and stopping of the forming table 5 are controlled in accordance with input information regarding the specifications such as the shape and size of the impeller disk 3 given by the input unit 26, the ascending and descending of the clamp shaft 11 are controlled, and the movement of the forming roll 15 due to the forming roll moving device 16 is controlled.

When forming the impeller disk 3 into the forming target shape, using the forming device A for the disk-shaped components of one or more embodiments having the above configuration, first, a material S1 which is cut to an appropriate size from a forging round bar is prepared, and the material S1 is processed to manufacture a columnar material S (S2) of a predetermined shape.

Subsequently, the material S made into a predetermined shape is heated to a predetermined temperature, and the high-temperature material S is placed on the central portion of the table plate 5*b* of the forming table 5. Next, the clamp shaft 11 is lowered by driving the clamp shaft elevator 13. As a result, the presser end portion 11*a* is pressed into the central portion of the material S such that it digs in from above, and the material S is held between the forming table 5 and the clamp 6. In a state in which the material S is set as described above, the forming table 5 is rotationally driven by the driving of the table driver 10.

Next, by driving the forming roll moving device 16, the forming roll 15 is pressed against the material S from above via the movable roll support 19. The forming roll 15 freely rotatable rotates in the rotational direction of the material S due to the pressing (pressurization, loading). Pressuring of the forming roll 15 on the material S in the pressed state is performed by moving the forming roll 15 from the central portion toward the outer circumferential portion of the forming table 5, while gradually bringing the forming roll 15 closer to the forming table 5, while keeping the tangential speed of the forming roll 15 constant. At this time, the movement of the forming roll 15 along the target shape of the impeller disk 3 is two-dimensionally controlled by the controller 17.

Thus, due to the plastic deformation of the material S in a hot state due to the forming roll 15, an envelope surface along a movement trajectory G of the forming roll 15, that is, an inclined surface 3*a* is formed on the material S to form the impeller disk 3.

Here, the forming device A for a disk-shaped component of one or more embodiments includes a heat retaining device 30 for heat-retaining the material so that the temperature of the material S does not drop below a predetermined temperature during forming.

Figure 3:
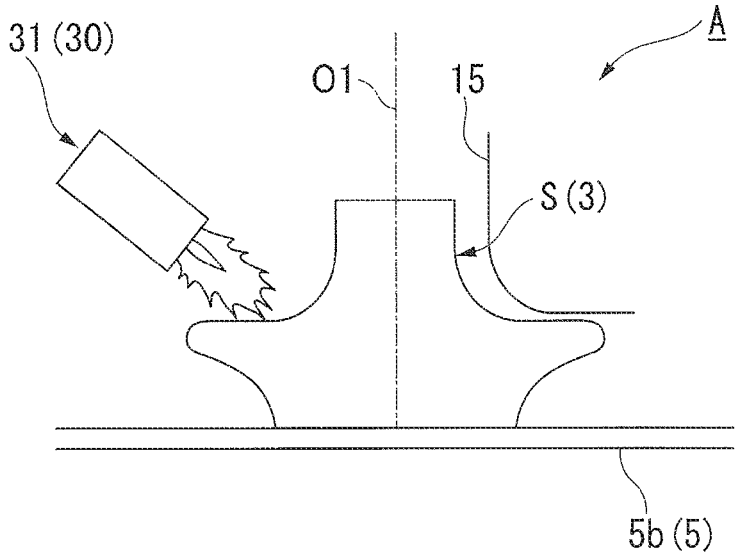
FIG. 3 is a view illustrating the forming device for a disk-shaped component and the forming method for a disk-shaped component according to one or more embodiments of the present invention, illustrating a case in which a burner is used as a heat retaining device.
Figure 4:
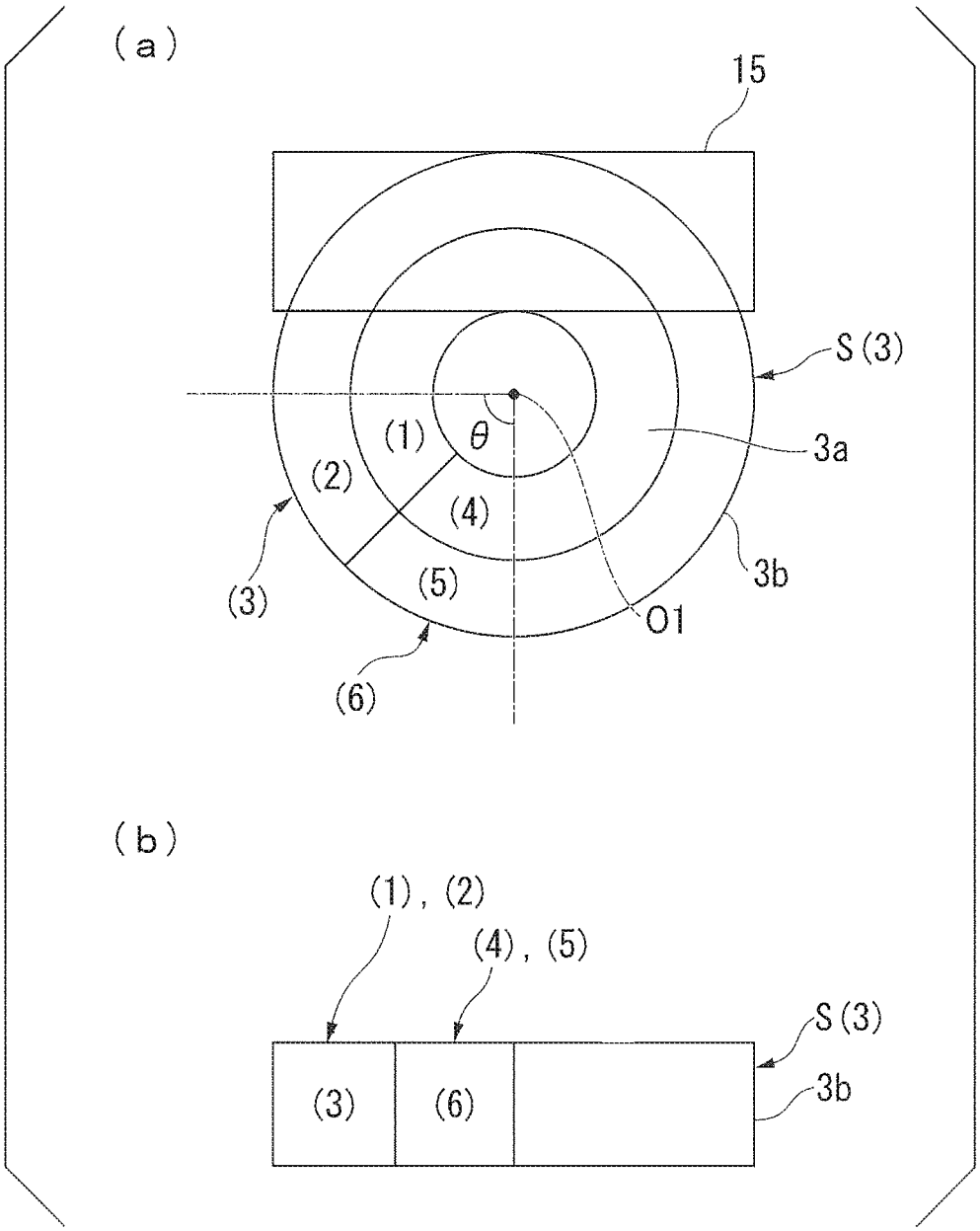
FIG. 4 is a view (a part indicated by (a) is a plan view, and a part indicated by (b) is a side view) illustrating an example of a range in which a material is heated (heat retained) by a heat retaining device, in the forming method for a disk-shaped component according to one or more embodiments of the present invention.

Further, in one or more embodiments, as illustrated in FIG. 3, a burner (gas burner) 31 may be used as the heat retaining device 30. Further, as illustrated in FIG. 4, the burner 31 as the heat retaining device 30 radiates a flame in an angular range θ of 20° to 180°, in an angular range θ of 90°, in the circumferential direction around the rotational axis O1 of the material S rotating together with the forming table 5 to heat the material S. In addition, in one or more embodiments, the burner 31 is disposed to radiate a flame to a part on the upstream side in the rotational direction with respect to the forming roll 15, so that the heated material S is pressurized by the forming roll 15 at an early stage.

Further, in one or more embodiments, as illustrated in FIG. 4, a part of the rotating material S on the upstream side in the rotational direction with respect to the forming roll 15 is divided into inner circumferential sides ((1), (4)) and outer circumferential sides ((2), (5)) of the upper surface, and side surfaces (outer circumferential surfaces) ((3), (6)) forming the outer circumference of the material S, the angular range θ of 90° in the circumferential direction is divided into two sections at 45°, and the angular range θ of 90° of the material S is divided into 6 sections ((1) to (6)) in total. A burner 31 is provided to heat each of individual sections (a total of three places) on the inner circumference side (1), the outer circumference side (5) and the side surfaces (3) among the divided six sections ((1) to (6)).

Figure 5:
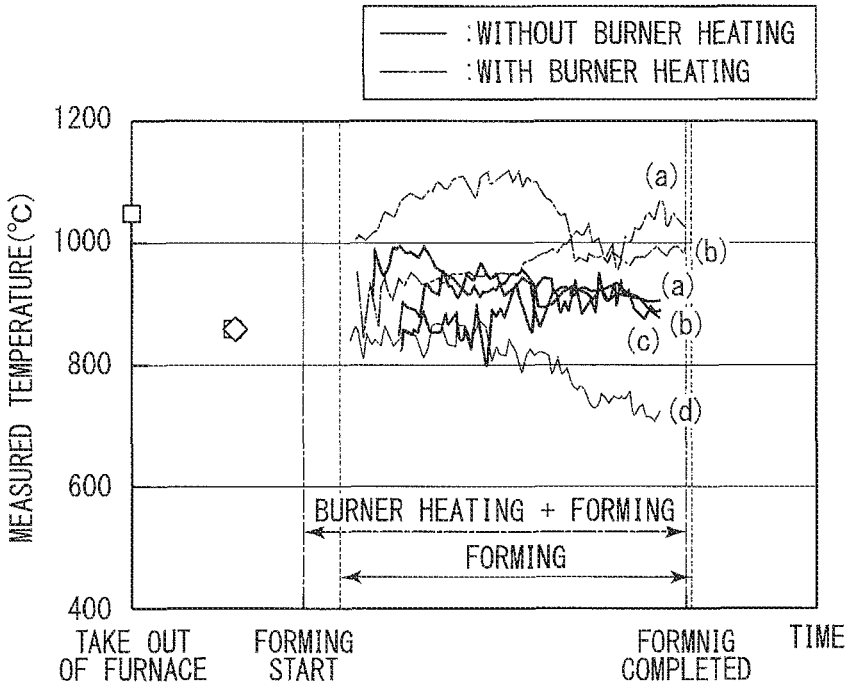
FIG. 5 is a view illustrating measured temperatures of a material in a case where a material is heated (heat retained) with a burner as a heat retaining device and a case where a burner is not used.

Here, FIG. 5 illustrates the temperature measurement results of the material S in a case where the material S is formed while heating (heat retaining) the material S with the burner 31 as the heat retaining device 30 as described above, using the forming device A having a maximum loaded weight of about 600 tons, and in a case where the material S is formed without using the heat retaining device 30.

Figure 6:
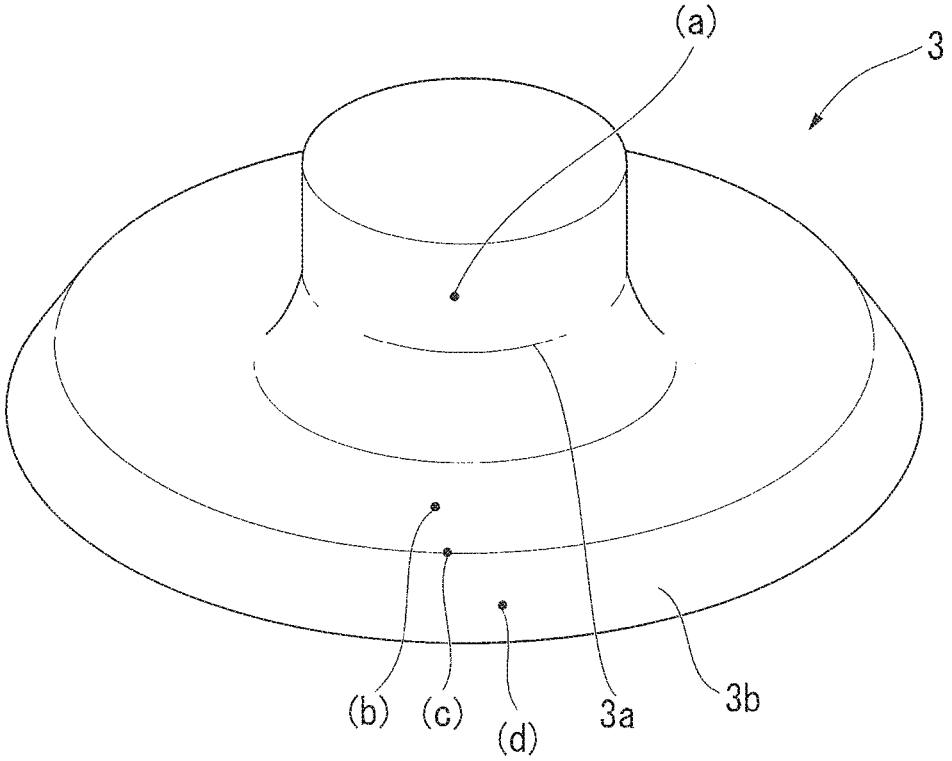
FIG. 6 is a view illustrating a material (impeller disk).
Figure 7:
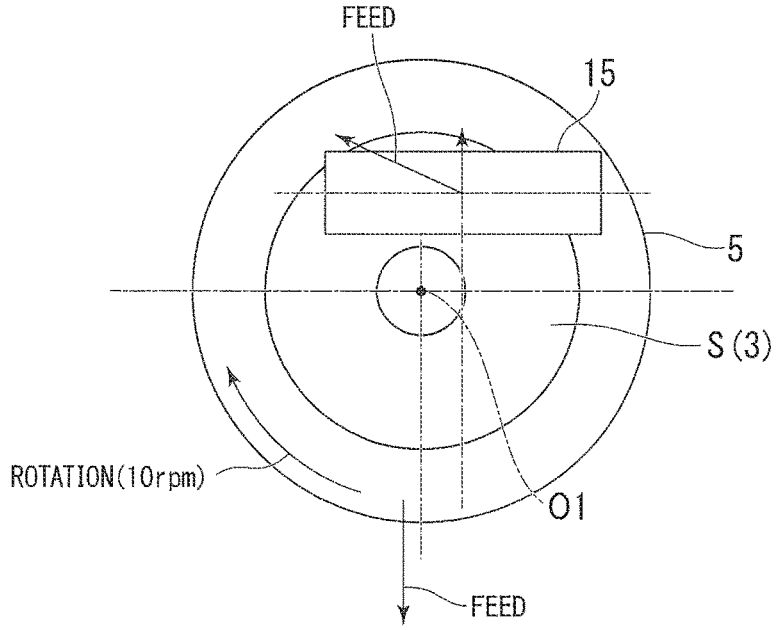
FIG. 7 is a view illustrating setting conditions of a simulation when using the forming method for a disk-shaped component according to one or more embodiments of the present invention.

In FIG. 5, a line indicated by (a) illustrates the temperature measurement results of the side surface of the central portion of the material S (the inclined surface 3*a* of the impeller disk 3), a line indicated by (b) illustrates the temperature measurement results of an outer circumferential side of the upper surface of the material S, a line indicated by (c) illustrates the temperature measurement results of the outer circumferential edge portion of the upper surface of the material S, and a line indicated by (d) illustrates the temperature measurement results of the side surface of the material S (see FIG. 6).

As illustrated in FIG. 5, when the material S is extracted from the furnace and is formed without using the heat retaining device 30 from the start of forming to the completion of forming, it was confirmed that the temperature of the material S during forming decreased from about 1,050° to about 900° and decreased to about 700° on the side surface of the material S, due to heat dissipation into the atmosphere, heat release through the table 5, and the like.

In contrast, in the case of forming the material S while heating the material S using the burner 31 as the heat retaining device 30, it was confirmed that a large temperature reduction did not occur from the start of forming to the completion of forming, that is, during forming.

Furthermore, in the case of forming the material S while heating the material S using the burner 31 as the heat retaining device 30, it was confirmed that the load (forming load, reaction force) during forming has been reduced by 100 to 150 tons, as compared with the case of forming the material S without using the heat retaining device 30.

Next, as illustrated in Table 1, while having a precondition that the burner 31 as the heat retaining device 30 is used, a simulation was performed under each of sets of conditions (Case 1, Case 2, and Case 3) in which the heat transfer coefficients for the material S of the forming roll 15, the table 5, or the clamp 6, and the initial temperature of the material S were changed, and the results of the forming analysis were compared and examined.

TABLE 1

| Analysis condition | | Case 1 | Case 2 | Case 3 |
|---|---|---|---|---|
| Roll | Initial temperature (° C.) | 100 | 100 | 100 |
| | Heat transfer coefficient for material (w/m$^2$k) | 373 | 373 | 373 |
| Table | Initial temperature (° C.) | 100 | 100 | 100 |
| | Heat transfer coefficient for material (w/m$^2$k) | 373 | 373 | 373 |
| Clamp | Initial temperature (° C.) | 100 | 100 | 100 |
| | Heat transfer coefficient for material (w/m$^2$k) | 373 | 373 | 373 |
| Material | Initial temperature (° C.) | 1050 | 1050 | 1170 |
| | Heat transfer coefficient for periphery (w/m$^2$k) | 6 | 0 | 6 |
| | Emissivity to surroundings (%) | 0.87 | 0 | 0.87 |

In the simulation, SUS630 was used as the material S, and the impeller disk 3 having an outer diameter of 1,500 mm was formed. Further, the initial material shape had a diameter of 660 mm and a thickness of 320 mm (see FIG. 7).

Figure 8:
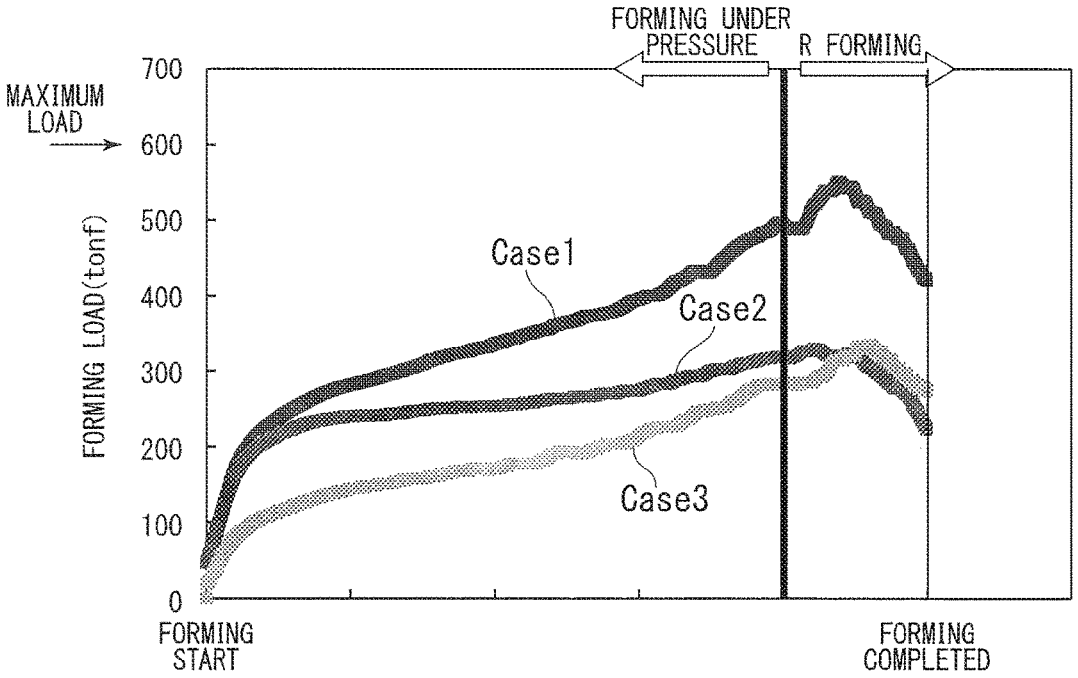
FIG. 8 is a diagram illustrating simulation results when using the forming method for a disk-shaped component according to one or more embodiments of the present invention.

FIG. 8 illustrates the results of the forming analysis of Case 1, Case 2, and Case 3 illustrated in Table 1. As illustrated in FIG. 1, when simulating the forming method for the disk-shaped component according to one or more embodiments using the burner 31 as the heat retaining device 30 (Case 2 and Case 3), it was confirmed that the impeller disk 3 of 1,500 mm could be formed, without reaching the maximum loaded weight of 600 tons. It was also confirmed that the result of the forming analysis was within 7.5% of the load accuracy with respect to testing of an actual machine by performing the test on an actual machine under the same conditions.

In this way, by forming the material S while heating the material S using the burner 31 as the heat retaining device 30, the decrease in temperature of the material S is suppressed, and the forming load can be greatly reduced. As a result, it was confirmed that a large-sized impeller disk 3 having an outer diameter of 1,500 mm could be suitably manufactured by roll forging.

Therefore, in the forming method for the disk-shaped component and the forming device A for the disk-shaped component according to one or more embodiments, when the disk-shaped component 3 such as the impeller disk is formed by roll forging, by heating (keeping warm/heat-insulating) the rotating material S using the heat retaining device 30, it is possible to suppress the decrease in temperature of the material S during forming. This makes it possible to inhibit or prevent the occurrence of forming load exceeding the equipment capacity due to the decrease in temperature of the material S or the occurrence of shape failure.

Therefore, for example, even in the existing equipment for roll forging in which the maximum loaded weight is about 600 tons and which is difficult to apply to large size forming when an outer diameter exceeds 1,350 mm, by adding the heat retaining device 30, it is possible to make this applicable to (support) manufacturing of molded articles of a large size exceeding 1,350 mm.

Further, in the forming method for the disk-shaped component according to one or more embodiments, it is possible to suppress the decrease in temperature of the material S during forming, by emitting a flame toward the material S using the burner 31 as the heat retaining device 30. As a result, it is possible to reliably inhibit or prevent occurrence of forming load exceeding the equipment capacity during forming or occurrence of shape failure in the molded article.

Further, by heating the material with the burner 31 as the heat retaining device 30, it is possible to set the deformation resistance of the material S to a predetermined value suitable for roll forging, for example, 20 kgf/mm$^2$ or less. As a result, the material S can be easily deformed, and efficiently formed.

Further, by heating the angular range θ of 20° to 90° in the circumferential direction of the rotating material S using the heat retaining device 30, it is possible to sufficiently suppress the decrease in temperature of the material S by the heat retaining device 30, while preventing occurrence of problems regarding the loaded weight applied to the material S by the forming roll 15.

Further, by heating the inner circumferential side of the upper surface of the material S, the outer circumferential side of the upper surface of the material S, and the side surface forming the outer circumference of the material S with the heat retaining device 30, it is possible to more sufficiently suppress the decrease in temperature of the material S.

Although one or more embodiments of the forming method for the disk-shaped component and the forming device for the disk-shaped component according to the present invention have been described above, the present invention is not limited to the above-described embodiments, and various modifications may be made within the scope that does not depart from the scope of the invention.

For example, in one or more embodiments, the burner 31 is used as the heat retaining device 30. However, as illustrated in FIG. 9, an electric heater or an IH (Induction Heating) heater 32 may be used as the heat retaining device 30, and the material S may be formed while heating the rotating material S by the electric heater or the IH heater 32 from the outer side.

Figure 9:
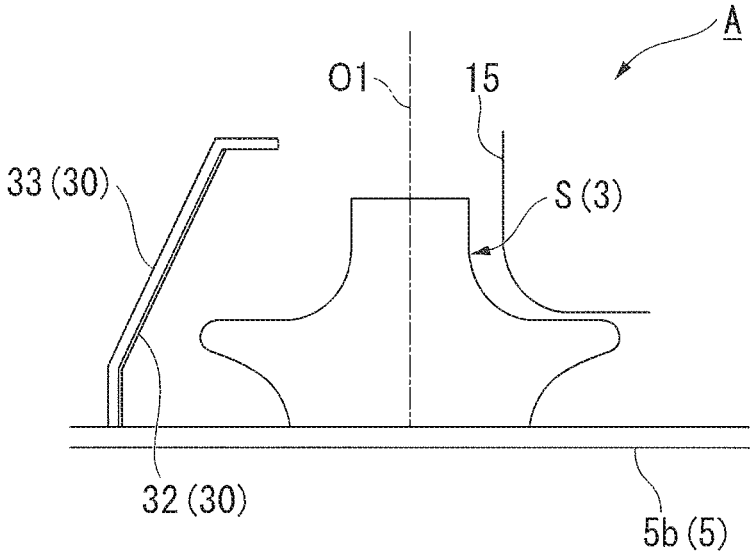
FIG. 9 is a view illustrating a forming device for a disk-shaped component and a forming method for a disk-shaped component according to one or more embodiments of the present invention, illustrating a case in which a heater and a heat insulating material are used as the heat retaining device.
Figure 10:
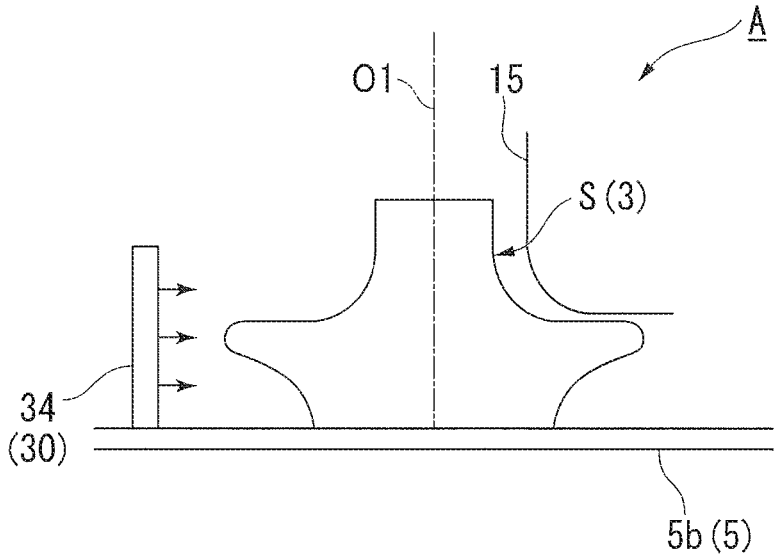
FIG. 10 is a view illustrating a forming device for a disk-shaped component and a forming method for a disk-shaped component according to one or more embodiments of the present invention, and illustrates a case in which a radiation material is used as a heat retaining device.
Figure 11:
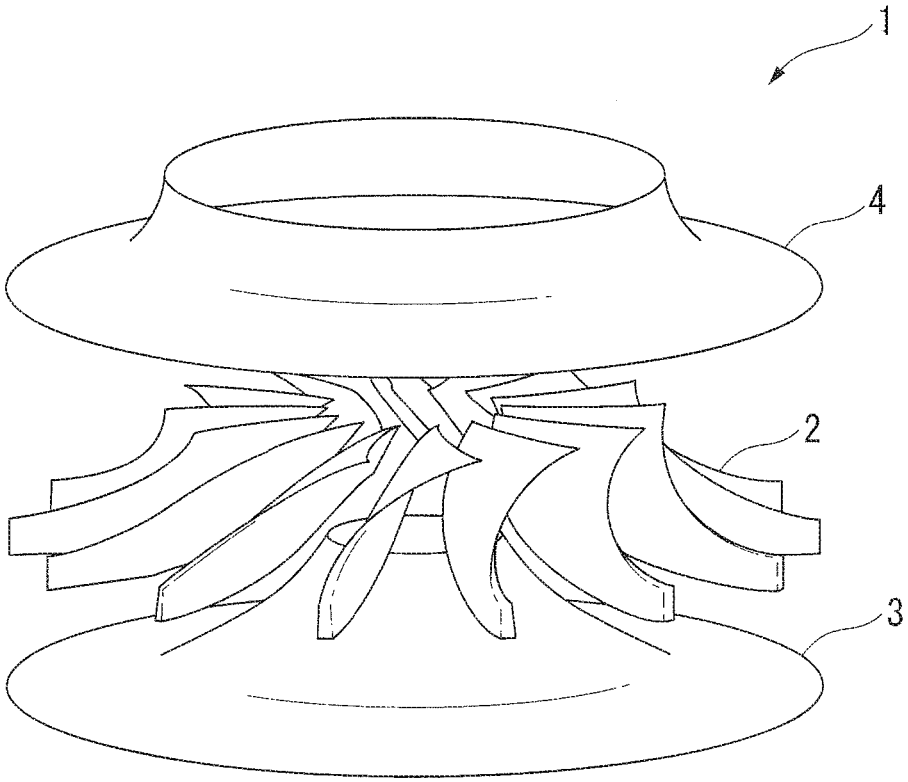
FIG. 11 is a view illustrating an impeller.

Further, as illustrated in FIGS. 9 and 10, at least one of a heat insulating material 33 and a radiation material 34 may be used as the heat retaining device 30, and the material S may be formed by disposing at least one of the heat insulating material 33 and the radiation material 34 on the outer side of the rotating material S.

With the heater 32, the heat insulating material 33, and the radiation material 34, it is also possible to suppress the decrease in temperature of the material S during forming as in one or more embodiments. Therefore, it is possible to inhibit or prevent the occurrence of a forming load exceeding the equipment capacity during forming or the occurrence of a shape failure in a molded article. That is, even in the existing equipment of roll forging which has a maximum loaded weight of about 600 tons and is difficult to apply to large-size forming when an outer diameter exceeds 1,350 mm, by adding the heater 32, the heat insulating material 33, or the radiation material 34 as heat retaining devices 30, it is possible to make this applicable to (support) manufacturing of a molded article of a large size exceeding 1,350 mm.

Further, it is possible to perform forming by appropriately selectively providing (using) the burners 31, heaters 32, heat insulating materials 33, and radiation materials 34 as the heat retaining device 30.

Further, in one or more embodiments, the description has been made on the assumption that the maximum loaded weight of the forming device A is about 600 tons and a molded article having a size of an outer diameter exceeding 1,350 mm is manufactured, but it is also possible to apply one or more embodiments of the present invention to a forming device A smaller than 600 tons or a forming device A which has a maximum loaded weight of 600 tons or more. In addition, the size of the disk-shaped component to be molded by applying one or more embodiments of the present invention is also not limited.

INDUSTRIAL APPLICABILITY

In the above-described forming method for the disk-shaped component and the forming device for the disk-shaped component, when forming a disk-shaped component such as an impeller disk by roll forging, it is possible to prevent the decrease in temperature of the rotating material during forming by heating/insulating the rotating material using a heat retaining device. This makes it possible to inhibit or prevent the occurrence of forming load exceeding the equipment capacity due to the decrease in temperature of the material or the occurrence of shape failure. Therefore, according to the forming method for a disk-shaped component and the forming device for a disk-shaped component of one or more embodiments of the present invention, for example, even with the existing equipment for roll-forging which is difficult to apply to forming with a large size outer diameter exceeding 1,350 mm, it is possible to make this applicable to (cope with) manufacturing of molded articles with a large size merely by adding a heat retaining device.

REFERENCE SIGNS LIST

1 Impeller
2 Blade
3 Impeller disk (disk-shaped component)
**3*a*** Inclined surface
**3*b*** Outer circumferential portion
4 Impeller cover (disk-shaped component)
5 Forming table (table)
**5*a*** Table base
**5*b*** Table plate
6 Clamp
7 Forming processing unit
10 Table driver
11 Clamp shaft
**11*a*** Presser end portion
12 Holder
13 Clamp shaft elevator
15 Forming roll
**15*a*** Roll circumferential surface
**15*b*** Roll end surface

15*c* Roll shoulder surface
16 Forming roll moving device
17 Control unit
18 Rotating shaft
19 Movable roll support
20 Bearing
25 Control unit
26 Input unit
30 Heat retaining device
31 Burner
32 Heater
33 Heat insulating material
34 Radiation material
A Forming device for disk-shaped component (disk roll device)
O1 Central axis (axis)
O2 Axis
S Material

The invention claimed is:

1. A forming method for an impeller disk, the method comprising:

mounting a material heated beforehand on a table;

applying a load to an upper surface of the material with a forming roll while rotating the table around a central axis extending in a vertical direction of the table;

forming the material into a disk shape using roll forging; and suppressing decrease in temperature of the material during forming using a heat retaining device, wherein the heat retaining device is a burner, and the material is formed while the material is heated by a flame emitted from the burner towards an inner circumferential side of the upper surface, an outer circumferential side of the upper surface, and a side surface forming an outer circumference of the material rotating on the table.

2. The forming method according to claim 1, wherein the heat retaining device is at least one of a heat insulating material and a radiation material, and the material is formed by disposing at least one of the heat insulating material and the radiation material on the outer side of the material rotating on the table.

3. The forming method according to claim 1, wherein the heat retaining device is disposed in a range of 20° to 180° in a circumferential direction about a rotational axis of the material, and the rotating material is heated or insulated by the heat retaining device in the range of 20° to 180° in the circumferential direction to suppress decrease in temperature of the material.

4. A forming device for an impeller disk, wherein the forming device mounts a material heated beforehand on a table, applies a load to an upper surface of the material with a forming roll while rotating the material by rotating the table around a central axis extending in a vertical direction of the table, and forms the material into a disk shape using roll forging, the forming device comprising:

a heat retaining device that suppresses decrease in temperature of the material during forming, wherein the heat retaining device is a burner, and the material is formed while the material is heated by a flame emitted from the burner towards an inner circumferential side of the upper surface, an outer circumferential side of the upper surface, and a side surface forming an outer circumference of the material rotating on the table.

* * * * *